US006832472B2

(12) United States Patent
Huang et al.

(10) Patent No.: US 6,832,472 B2
(45) Date of Patent: Dec. 21, 2004

(54) METHOD AND APPARATUS FOR CONTROLLING EXHAUSTED GAS EMISSIONS DURING COLD-START OF AN INTERNAL COMBUSTION ENGINE

(75) Inventors: Yiqun Huang, San Antonio, TX (US); Joseph Grogan, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 75 days.

(21) Appl. No.: 10/444,222

(22) Filed: May 23, 2003

(65) Prior Publication Data

US 2003/0230074 A1 Dec. 18, 2003

Related U.S. Application Data

(60) Provisional application No. 60/389,322, filed on Jun. 17, 2002.

(51) Int. Cl.[7] ..... F01N 3/00

(52) U.S. Cl. ..... 60/285; 60/274; 60/276; 60/284; 123/435; 123/491; 123/406.26

(58) Field of Search ..... 60/274, 276, 284, 60/285; 123/305, 406.13, 406.14, 406.26, 406.27, 435, 491

(56) References Cited

U.S. PATENT DOCUMENTS 4,031,747 A 6/1977 Blanke
4,905,654 A 3/1990 Katsuno et al.
5,363,091 A 11/1994 Kotwicki et al.
5,947,077 A * 9/1999 Yonezawa et al. ..... 123/295
6,073,611 A * 6/2000 Ohuchi et al. ..... 123/435
6,089,016 A * 7/2000 Takaku ..... 60/277
6,161,531 A 12/2000 Hamburg et al.
6,199,540 B1 * 3/2001 Katashiba et al. ..... 123/478
6,210,641 B1 4/2001 Yamada et al.
6,276,129 B1 8/2001 Booth et al.
6,301,880 B1 10/2001 Cullen et al.
6,530,361 B1 * 3/2003 Shiraishi et al. ..... 123/435
2001/0035172 A1 11/2001 Osaki et al.

* cited by examiner

*Primary Examiner*—Binh Q. Tran
(74) *Attorney, Agent, or Firm*—Gunn & Lee, PC

(57) ABSTRACT

An in-cylinder ion sensor provides a signal representative of the air/fuel ratio of the charge mixture as an engine starts. The signal representative of the air/fuel ratio is used as a feedback signal for an electronic control unit to perform cold-start closed-loop control during an initial operating period from a cold-start before an on-board oxygen sensor is able to warm up. After reaching a functional operating temperature, the oxygen sensor provides a signal that is used as an adaptive calibration tool which allows the electronic control unit to calibrate the ion sensor signal and use that signal for controlling the air/fuel ratio during cold start operation.

12 Claims, 3 Drawing Sheets

METHOD AND APPARATUS FOR CONTROLLING EXHAUSTED GAS EMISSIONS DURING COLD-START OF AN INTERNAL COMBUSTION ENGINE

This is a nonprovisional application claiming priority to U.S. Provisional Application Ser. No. 60/389,322 filed Jun. 17, 2002.

BACKGROUND OF THE INVENTION

1. Technical Field

This invention relates generally to exhaust gas emission control for internal combustion engines, and more particularly to the control of emissions during cold-start operation.

2. Background Art

An oxygen sensor, often referred to as an $O_2$ sensor, a lambda sensor or an exhaust gas oxygen (EGO) sensor, is one of the most critical sensors on internal combustion engines, particularly fuel-injected gasoline-fueled engines. An oxygen sensor somewhat resemble a spark plug in external appearance and is located in the exhaust manifold upstream of a catalytic converter, preferably in close proximity to an exhaust port. When at operating temperature, an oxygen sensor becomes a miniature battery that generates a voltage based on the differential between the oxygen content of the exhaust gas and the oxygen content of the ambient air. Accordingly, an oxygen sensor can readily provide an electrical signal representative of the amount of oxygen in the exhaust stream to an electronic control unit (ECU) that controls one or more engine parameters such as the air/fuel A/F ratio. Thus, a major benefit of the oxygen sensor is the ability to control, through the signal supplied to the ECU, exhaust emissions such as carbon monoxide, oxides of nitrogen and unburned hydrocarbons.

However, an oxygen sensor must be heated to a temperature of at least about 300° C. (about 600° F.) before it will start to function, and operates best at a temperature around 750° C. (about 1400° F.). Before an oxygen sensor reaches operating temperature, typically about 1 to 2 minutes after a cold start, the vehicle electronic control unit runs in what is termed "open loop", where the ECU tosses out the information provided by the oxygen sensor and relies upon preset values to control the air/fuel ratio. This generally results in a fuel-rich state to ameliorate starting problems when the engine is cold.

EPA Federal Test Procedure (FTP75) sets forth the procedure to be used to certify new engine designs, and requires that the engine be run on a simulated driving cycle lasting 2,477 seconds and 11.1 miles. The test procedure starts with a cold-start after an overnight cool down (12 hours) at an ambient temperature of 20–30° C. At 20–30° C., only about 10% of the components in gasoline are sufficiently volatile and evaporate. Typically, gasoline engines achieve cold-start by massive over fueling, which supplies the "lightest fractions" in sufficient quantities for the engine to start from the light fractions alone. In carrying out EPA Federal Test Procedure 75, it has been determined that about 60–80% of the total tailpipe hydrocarbon emissions produced in the course of the test are produced within the first 60–120 seconds after startup of the engine from a cold start.

Therefore, a major source of cold start hydrocarbon emissions is engine misfire due to the inability of gasoline to easily evaporate when sprayed onto a cold engine surface. Typically, the fuel is targeted at the back of the intake valve, because it is generally the hottest surface in the engine intake system. However, the back of the intake valve takes about a minute to heat up once the engine is started. Other sources of high tailpipe hydrocarbon (HC) emissions during cold-start include misfire due to poor air/fuel (A/F) ratio control, the catalytic converter does not "light-off," (i.e., it does not achieve 50% efficiency in reducing pollutants) until several minutes after a cold start, and poor A/F ratio due to open loop control before the warmup of the exhaust gas oxygen (EGO) sensor.

On engines in which the air/fuel ratio is controlled by an oxygen sensor, other control methods must be employed to reduce exhaust emissions upon a cold engine start. For example, in an attempt to overcome poor A/F ratio control during cold startups, U.S. Pat. No. 6,161,531, issued Dec. 19, 2000, to Hamburg, et al. for *Engine Control System With Adaptive Cold-Start Air/Fuel Ratio Control,* describes an adaptive correction method for adjusting, or modifying, preset control parameters during cold-start through the use of an EGO sensor. The adaptive correction method is an open loop correction based upon a preestablished correction table. More specifically, Hamburg, et al. uses the EGO sensor to correct the table used for cold-start air/fuel ratio control.

Other techniques commonly used for reducing cold-start emissions include heating the fuel mixture to reduce problems associated with initial enrichment, modifications to the engine, fuel gasification (including reforming to $COH_2$) and close-coupling of the catalytic converter to the exhaust port. Other techniques for reducing cold-start emissions include retarding ignition timing, installing traps in the exhaust system, secondary air injection upstream of the catalytic converter, and the use of faster warmup oxygen sensors to reduce the time in open loop control.

The present invention is directed to overcoming the above described problems associated with current methods of controlling exhaust gas emissions during cold engine starts. It is desirable to have an effective closed loop control to regulate the air/fuel ratio under cold-start conditions. It is also desirable to have a method for controlling cold-start emissions by a closed loop system in which sensors used in the closed loop control are adaptively calibrated during normal engine operation.

SUMMARY OF THE INVENTION

In accordance with one aspect of the present invention, a method for controlling exhaust gas emissions during cold-start of an internal combustion engine having an ion sensor disposed either within or in close proximity to a combustion chamber of the engine includes introducing a mixture of air and fuel in the combustion chamber, combusting the mixture of air and fuel within the combustion chamber and generating a plurality of positively charged ions having a magnitude representative of the oxygen content of the fuel and air mixture. The amount of ions existing in the combusted mixture of air and fuel is sensed by the ion sensor and a signal is thereby generated having a value representative of the oxygen content of the combusted air and fuel mixture. The signal representative of the oxygen content of the combusted air and fuel mixture is compared with a desired value representative of ions produced in an idealized combusted air and fuel mixture. Any difference between the sensed value of the ions existent in the combusted fuel mixture and the desired value of ions in the combusted mixture is determined, and a signal correlative of the difference between the sensed and desired values is generated. A signal controlling the mixture ratio of air and fuel introduced into the combustion chamber is adjusted in accordance with the generated signal correlative of the difference between the sensed and desired values of ions in the combusted mixture.

Other features of the method for controlling exhaust gas emissions during cold-start in accordance with the present invention include using a spark plug disposed in the combustion chamber as a sensor for sensing the concentration of ions existent in the combusted mixture of air and fuel.

Additional features of the method for controlling exhaust gas emissions during cold-start in accordance with the present invention include heating an oxygen sensor disposed in an exhaust system of the engine to a predetermined functional operating temperature and receiving a signal from the oxygen sensor representative of the oxygen content of exhaust gas discharged from the combustion chamber. The signal received from the oxygen sensor is used to calibrate the signal from the ion sensor.

In another aspect of the present invention, an apparatus for controlling exhaust gas emissions during cold-start of an internal combustion engine includes an ion sensor disposed either within or in close proximity to a combustion chamber, and an engine control unit adapted to receive a signal from the ion sensor that is correlative of the magnitude of ions existent in a mixture of air and fuel combusted within the combustion chamber. The engine control unit is also adapted to compare the value of the signal received from the ion sensor with a desirable value of ions present in a combusted air and fuel mixture for mitigation of undesirable products of combustion in exhaust gases discharged from the engine. The engine control unit is further adapted to generate control signals that are modified in accordance to the difference between the sensed value of ions existent in the combusted fuel mixture and the desired value of ions in the combusted mixture. The apparatus further includes a fuel injector disposed in fluid communication with the combustion chamber and adapted to receive one of the modified control signals generated by the engine control unit and inject fuel into the engine in accordance with the modified control signal.

Other features of the apparatus embodying the present invention include the ion sensor being a spark plug having a tip portion disposed within the combustion chamber and adapted to receive another one of the modified control signals generated by the engine control unit and produce electrical charges within the combustion chamber in accordance with the modified control signal.

Another feature of the method embodying the present invention includes calibrating the signal generated by the ion sensor to bring the value of the ion sensor signal into congruence with a signal generated by an oxygen sensor disposed in the exhaust system of the engine.

BRIEF DESCRIPTION OF THE DRAWINGS

A more complete understanding of the method and apparatus for controlling exhaust gas emissions during the cold-start of an internal combustion engine may be had by reference to the following detailed description when taken in conjunction with the accompanying drawings, wherein.

DETAILED DESCRIPTION OF THE INVENTION

In spark ignition engines, ionization is created by the process of chemi-ionization during the hydrocarbon combustion reaction. This is an exothermic reaction wherein the released reaction energy is large enough to ionize the reaction products. The most important chemi-ionization reaction in flames is expressed as:

$$CH+O \rightarrow CHO^{+}+e^{-}.$$

After this reaction, a dominating $H_3O^+$ ion is formed via a charge transfer reaction:

$$CHO^{+}+H_2O \rightarrow H_3O^{+}+CO.$$

This reaction is a reduction reaction and is faster than the earlier production reaction. Therefore, the concentration of $H_3O^+$ ions is much higher than that of $CHO^+$. Therefor, it can be seen that the greater the amount of fuel (expressed by CH in the initial formula) the greater the concentration of $H_3O^+$ ions in the reduction reaction product. Thermal ionization processes produce free electrons as temperature increases in the combustion chamber, and can be described by the following reaction:

$$M+E^{ion} \leftrightarrows M^{+}+e^{-},$$

where M represents a generic molecule, $M^+$ is a generic positive ion, e.g., $H_3O^+$ produced by the previous reaction, $e^-$ is an electron, and $E^{ion}$ is the ionization energy.

The ions produced by chemi-ionization and thermal ionization will, after a short time, recombine with an electron and form a more stable molecule. The highest ion concentrations are on the order of $10^{17}$ to $10^{18}$ ions/m$^3$, or approximately one ion pair for every $10^6$ reacted carbon atoms that exist in the flame reaction zones. After combustion, the ion concentration decays rapidly to values around $10^{14}$ ions/m$^3$. The actual concentration of ions in the combustion chamber is therefor mainly dependent upon the amount of $H_3O^+$ ions formed in the initial combustion reaction. Such concentrations persist in the combustion chamber and in the exhaust gas to yield a current source to a sensor positioned within the combustion chamber, or in an exhaust manifold close to the exhaust valves, that is representative of the air/fuel ratio of the charge mixture and the completeness of the combustion reaction. In an ideal, i.e., stoichiometric, reaction at sea level the ratio of air to fuel is about 14.6. The peak in-cylinder ionization level in internal combustion engines decreases as the air/fuel ratio is varied away from a value near stoichiometric. Therefore, there is a correlation between the ionization level in the cylinder and the air/fuel ratio, and that correlation is used in accordance with the present invention to control the air/fuel ratio of the charge mixture.

Figure 3:
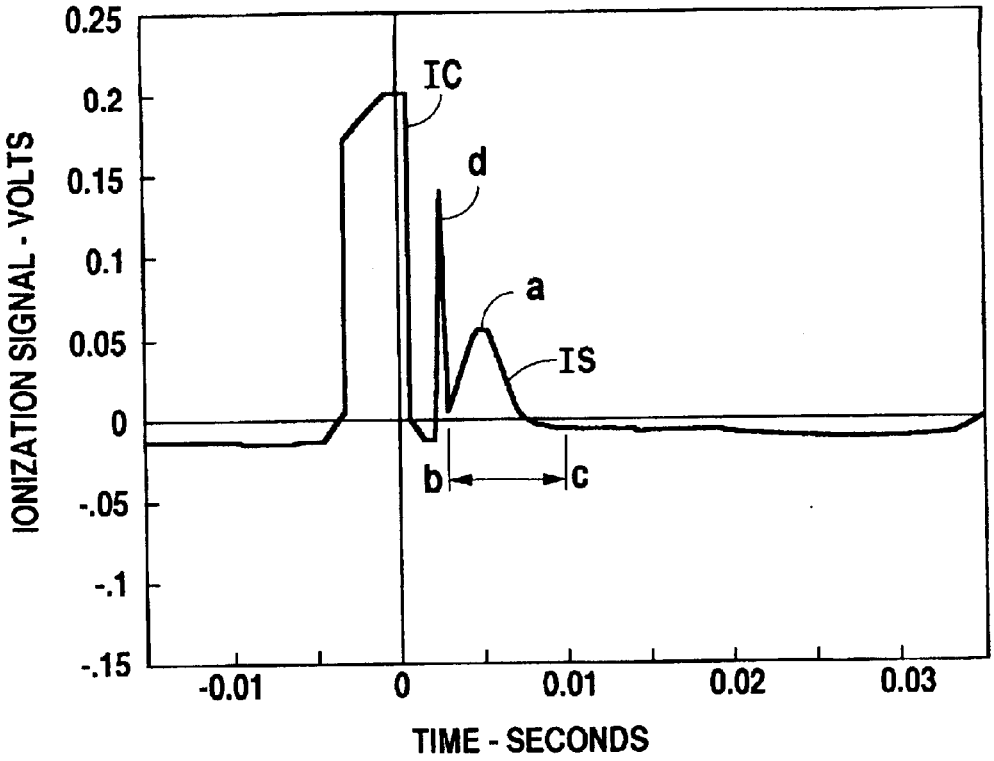
FIG. 3 is a graphical representation of ionization signal generated by a spark plug in a typical spark ignited gasoline engine in accordance with the present invention; and, FIG. 4 is a drawing showing the architecture of a neural network used in carrying out a preferred embodiment of the present invention.

An ionization signal generated by a typical spark ignited gasoline engine is represented by the line identified as IS in FIG. 3. Right after the ignition command IC there is a spike d on the ionization curve IS, caused by the spark resulting from the ignition command IC. In a preferred embodiment of the present invention, the portion if the ionization signal IS represented by the spike d is not used in the illustrative calculations described below. The portion of the ionization signal IS extending between points b and c is used in accordance with the present for control of the air/fuel ratio during cold start extends between points b and c.

common technique for quantifying the relative amounts of fuel and air in a mixture is through the use of fuel/air equivalence ratio, usually identified simply as the equivalence ratio. The equivalence ratio is the actual fuel/air ratio divided by the stoichiometric fuel/air ratio. Thus, when the equivalence ratio is one (1.0), the actual mixture is stoichiometric.

The parameters used to calculate an equivalence ratio from the ionization signal IS is the area under the ionization curve between points b and c, the amplitude a of the ionization curve, and the time interval of the peak ionization signal a after the ignition command IC.

The operating parameters of an engine directly affect the above-described three ionization signal characteristics. For example, with an increase in engine speed, the area under the ionization curve and the amplitude of the ionization curve increases, while the time interval of the peak ionization signal curve after the ignition command decreases. With an increase in load, at constant speed, very low load to a higher load, the peak amplitude of the ionization signal increases, but not dramatically. The time interval of the ionization signal peak after the ignition command becomes shorter with the increased load. The shape of the ionization signal curve changes from symmetric at no or very low load to only half of the original area under medium load.

Figure 1:
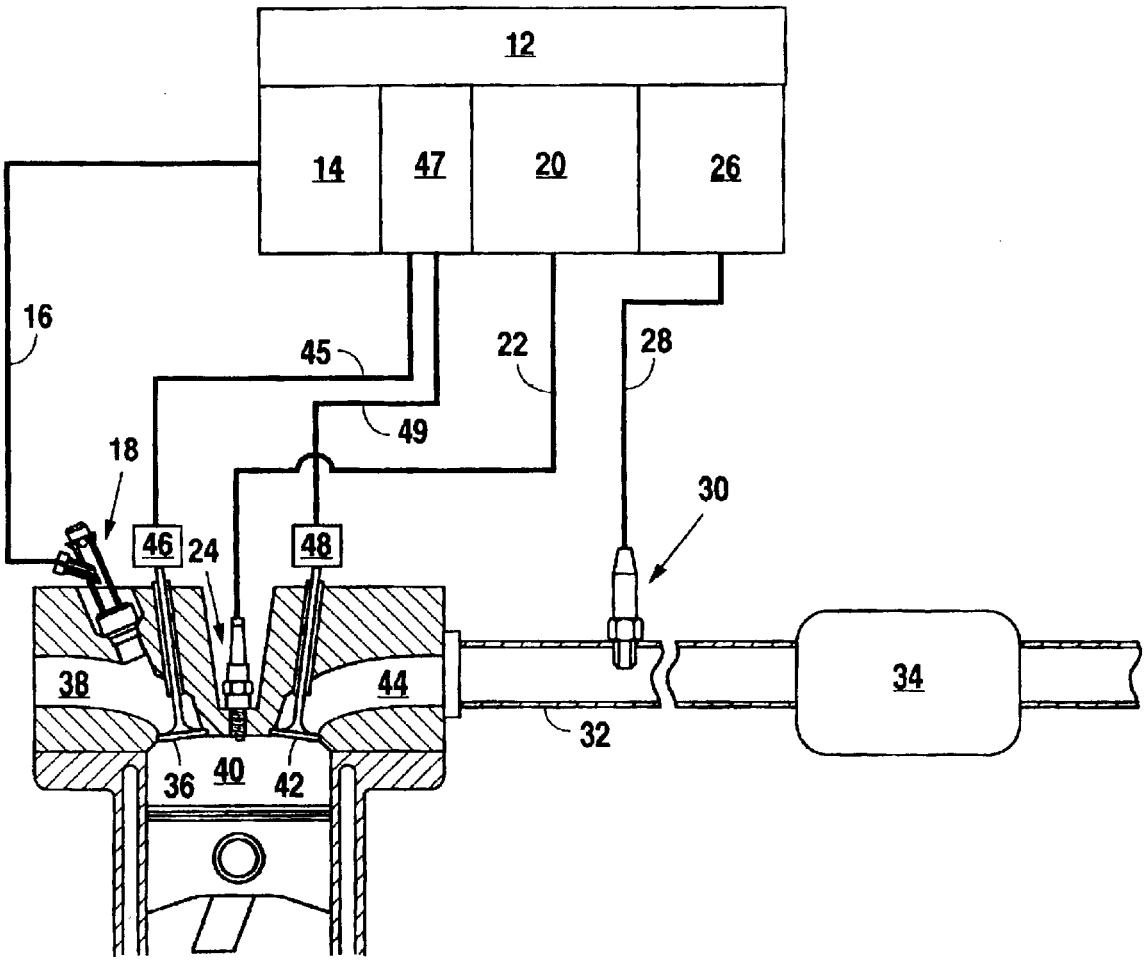
FIG. 1 is a schematic illustration of the apparatus for controlling exhaust gas emissions during cold-start of an internal combustion engine in accordance with the present invention.

An exemplary preferred embodiment of the apparatus for controlling exhaust emissions during cold-start operations is illustrated in FIG. 1. An internal combustion engine, such as a spark-ignition engine, has an engine control unit (ECU) 12. The ECU 12 includes a fuel injector driver 14 that provides a signal 16 to a fuel injector 18, typically disposed in an inlet port 38 at a position adjacent to an intake valve 36. The ECU 12 also includes an ignition and ion detection module 20 that, by way of a signal conductor 22, is in electrical communication with a spark plug 24 having a tip portion disposed within a combustion chamber 40 of the engine. In the illustrative embodiment, the spark plug 24 also serves as an ion sensor to detect the magnitude of ions produced by chemi-ionization and thermal ionization during the combustion process, as described above, and deliver a first signal correlative of the magnitude of ions existent in a combusted mixture of air and fuel, by way of the signal conductor 22. The ECU 12 further has an EGO, or oxygen ($O_2$), sensor input 26 that is adapted to receive a third signal 28, representative of the oxygen content of exhaust gases discharged from the combustion chamber 40, from an EGO sensor 30 disposed in an exhaust manifold 32 of the engine 10 at a position between an exhaust valve 42 which provides communication between the combustion chamber 40 and an exhaust port 44, and an exhaust gas catalytic converter 34.

In an alternative embodiment applicable to either spark or compression ignition engines, the ECU 12 may also include a valve actuator driver 47. The valve actuator driver 47 provides a first signal 45 to a first valve actuator 46 operatively connected to the intake valve 36 to provide variable valve actuation (VVA) of the intake valve or, if desired, selective deactivation of the engine cylinder defined by the combustion chamber 40. The valve actuator driver 47 also provides a second signal 49 to a second valve actuator 48 operatively connected to the exhaust valve 42 to provide variable valve actuation (VVA) of the exhaust intake valve or, if and when desired, selective deactivation of the engine cylinder.

Figure 2:
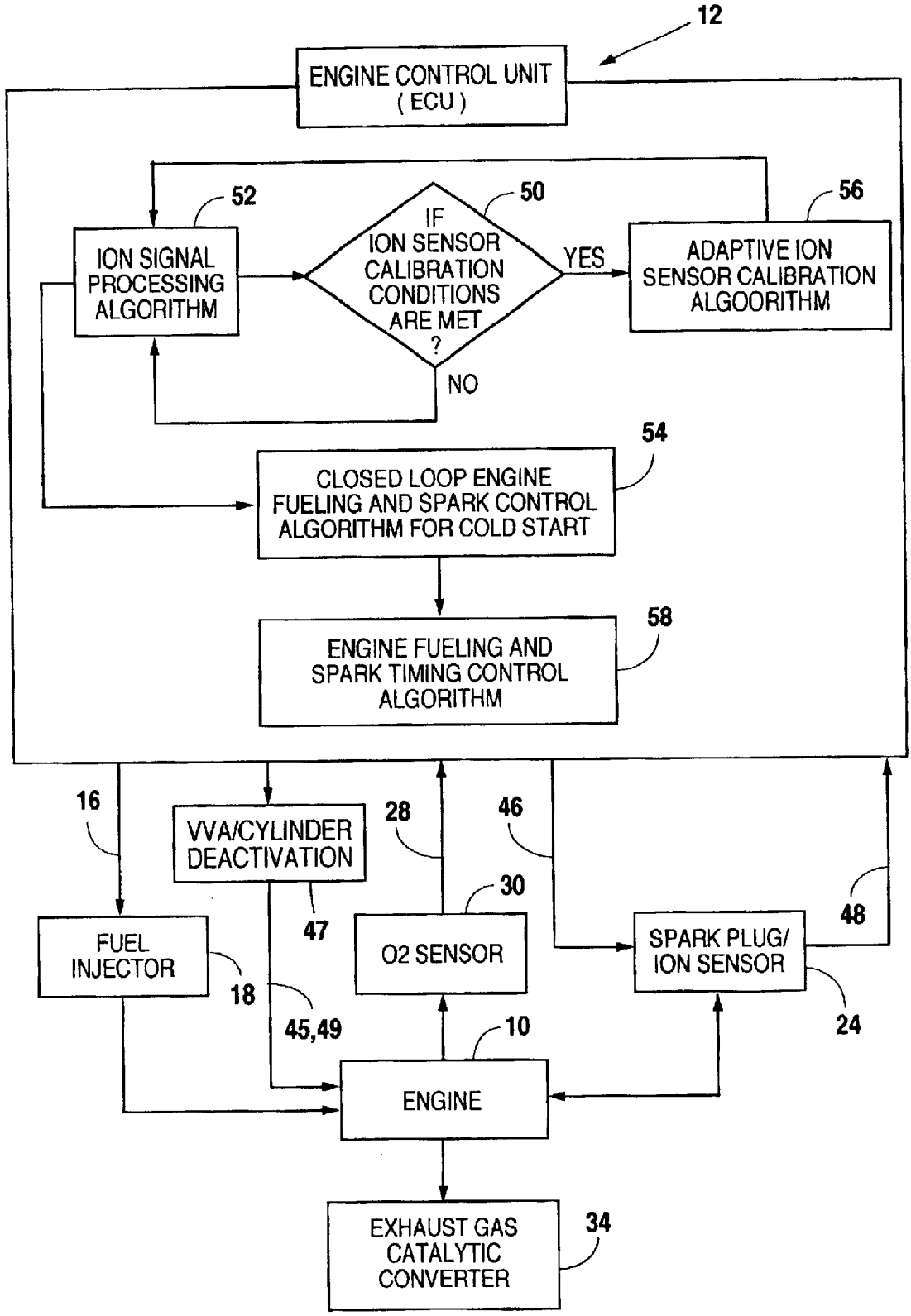
FIG. 2 is a flow diagram of the protocol employed in carrying out the method for controlling exhaust gas emissions during cold-start of an internal combustion engine in accordance with the present invention.

The flowchart presented in FIG. 2 illustrates a preferred embodiment for the processing of signals and algorithms used in carrying out the present invention. Preferably, the ion sensing spark plug 24 is a conventional spark plug and, accordingly, does not need time to warm up like the $O_2$ sensor 30. The ion sensing spark plug 24 provides in-cylinder ion signals 48 as soon as combustion occurs. In the preferred embodiment of the present invention, the calculation of mixture equivalence ratio from the in-cylinder ionization signal 48, i.e., the ion signal processing algorithm represented by block 52 in FIG. 2, is expressed as follows:

$$\phi_{ION}=f(A, t, P, N, M, T, F, G), \quad 1)$$

where, $\phi_{ION}$: measurement of equivalence ratio of mixture from the ionization signal, A: area under the ionization signal curve, t: time between the ignition command and the peak amplitude of the ionization signal curve, P: the peak amplitude of the ionization signal curve, N: engine speed, M: engine torque, T: engine coolant temperature, F: fuel properties (including additives), and G: spark plug gap conditions.

Figure 4:
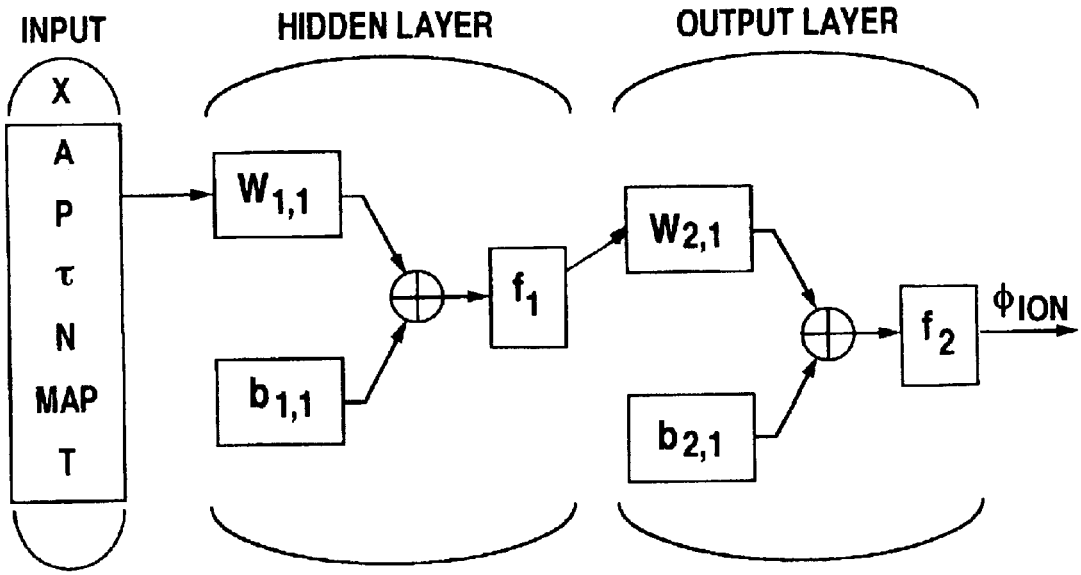

This function is best estimated by a neural network, the architecture of which is shown in FIG. 4. The model neural network is a multi-layer network consisting of one hidden layer and one output layer. In the model neural network illustrated in FIG. 4, $W_{1.1}$ is the weight matrix, $b_{1.1}$ is the bias vector and $f_1$ is the transfer function of the hidden layer. $W_{2.1}$ is the weight matrix, $b_{2.1}$ is the bias vector and $f_2$ is the transfer function of the output layer.

The above network structure is first trained offline by varying the air/fuel ratio and the engine speed and load as well as coolant temperature. The air/fuel ratio measurement is obtained by the oxygen sensor 30 after it reaches its functional operating temperature. These data are used to train the neural network model and enable it to predict the air/fuel ratio from the ionization signal, engine speed and load, and coolant temperature.

Once the neural network is trained, the weight matrixes are obtained and the neural network computes the output value $\phi_{ION}$ as:

$$\phi_{ION}=f(W\cdot X+b), \quad 2)$$

where $f$ is the neural network function,

W is the weight matrixes of the neural network,

X is the input vector, and b is the bias vector.

Desirably, the offline base point calibration is performed at idle conditions where engine speed and load can be repeated later, as represented at block 56 in FIG. 2, for the online calibration of the ionization signal to reflect the effects of fuel properties and sparkplug conditions.

Spark plugs are routinely replaced during periodic engine maintenance. When a spark plug is changed, the ion sensor function of the spark plug will need to be recalibrated, a process accomplished on-line in accordance with the present invention using the $O_2$ sensor signal 28 after the $O_2$ sensor 30 has warmed up to its functional operating temperature.

In order to calibrate the air/fuel ratio measurement online for engine operating parameters that are at variance from the original calibration condition, an engine operation condition for online calibration must be selected at which engine speed, load and coolant temperature have minimum effect on the ionization signal.

Preferably, the engine operating condition selected for carrying out the online calibration is at idle. At idle, engine speed is easily controlled to a known value by the ECU 12. The effect of engine coolant temperature on the ionization signal is primarily on the time interval between the peak amplitude of the ionization signal curve and the ignition command, not on the area and the amplitude of the peak of the ionization signal. Higher engine coolant temperature shortens the time interval between the peak ionization signal and the ignition command. This effect can be compensated by establishing correlation between the time interval and coolant temperature.

During normal engine operation after the oxygen sensor 30 has reached its functional operating temperature, the engine air/fuel ratio is controlled by the ECU 30, based on the value provided by the oxygen sensor. Generally, the air/fuel ratio is controlled to provide an equivalence ratio value of 1.0, i.e., a stoichiometric mixture. During such operation, the neural network air/fuel ratio prediction model based on ionization signals is trained, or calibrated, online with the current inputs.

As described above, the online calibration of the model, as indicated at block 56 of FIG. 2, for the effects changes in fuel properties and spark plug conditions, is desirably carried out when the engine is operating at idle. At idle, other operating parameters which affect the ionization signal, such as engine speed and load are the same as the offline base point calibration conditions. Therefor, it can be deduced that the primary difference between the current measured value of the ionization signal and the offline calibration is attributable to variations in fuel properties and spark plug conditions. The differences can be expressed in the following three terms:

3) ΔA: the difference in area under the ionization curve.
4) Δt: the difference in time interval between the ignition command and the peak amplitude of the ionization signal curve,
5) ΔP: the difference in the peak amplitude of the ionization curve.

The input values of area A, time interval t and peak amplitude P are corrected by multiplying factors which, respectively, are functions of the differences and are also normalized by their new values obtained at the idle condition, as follows:

$$A_{input} = \frac{A_{mea} \cdot f(\Delta A)}{A_{bas\,online}}, \text{ where} \quad 6)$$

$$\Delta A = A_{bas\ online} - A_{bas_init}$$

$A_{mea}$: present measurement of area $A_{base_init}$: area measured at initial idle condition $A_{bas\ online}$: area measured at idle after Initial idle condition $f(\Delta A)$: correction factor of ΔA.

Similarly, corrections of the time interval and peak amplitude are represented respectively by the following equations 7 and 8:

$$\tau_{input} = \frac{\tau_{mea} \cdot f(\Delta\tau)}{\tau_{\text{bas_online}}}, \text{ where} \quad (7)$$

$$\Delta t = t_{bas_online} - t_{bas_init}$$

$t_{mea}$: present measurement of time interval $t_{bas_init}$: time interval measured at initial idle condition $t_{bas\ online}$: time interval measured at idle after initial idle condition $f(\Delta t)$: correction factor of Δt.

$$P_{input} = \frac{P_{mea} \cdot f(\Delta P)}{P_{\text{bas_online}}}, \text{ where} \quad 8)$$

$$\Delta P = P_{bas_online} - P_{bas_init}$$

$P_{mes}$: present measurement of peak amplitude $P_{bas_init}$: area measured at initial idle condition $P_{bas\ online}$: time interval measured at idle after initial idle condition $f(\Delta P)$: correction factor of ΔP.

Thus, it can be seen that if engine intake manifold pressure (MAP) is used to indicate engine load, the measurement of the equivalence ratio $\phi_{ION}$ initially identified in Equation 1 can be expressed, as follows:

$$\phi_{ION} = f(A_{input}, t_{input}, P_{input}, N, MAP, T). \quad (9)$$

Turning again to FIG. 2, closed loop, on-line calibration of the ionization signal 48 is calibrated within the ECU 12 by comparison with the third signal 28 provided by the $O_2$ sensor 30 after the $O_2$ sensor has reached its functional operating temperature. More specifically, a determination is made as to whether ion sensor calibration conditions are met, i.e., has the $O_2$ sensor 30 reached its functional thermal operating state, as indicated in decision Block 50 in FIG. 2. If the ion sensor calibration conditions are met, an adaptive ion signal processing algorithm, represented by Block 56, applies a correction factor to calibrate the ionization signal 48 so that the air/fuel mixture ratio value indicated by the ionization signal is congruent with the air/fuel mixture ratio value measured by the oxygen sensor 30. The ion signal processing algorithm, represented by block 52, supplies a calibrated signal that is used during cold start engine conditions to provide closed-loop engine fueling and spark control, as indicated at Block 54.

As described above, if ion sensor calibration conditions are met the adaptive ion sensor calibration algorithm, Block 56, determines what, if any, correction needs to be made to the signal 48 received from the ion sensor 24 to bring that signal into agreement with the signal 28 provided by the $O_2$ sensor 30, and stores the calibration data in a non-volatile memory of the ECU 12. The calibration information is provided to the ion signal processing algorithm at Block 52 to adaptively recalibrate the ion sensor signal 28 and thereby provide a viable signal for the closed-loop, engine fueling and spark control during cold-start as represented at Block 54 and the engine fueling and spark timing control algorithm represented by Block 58.

With reference to FIG. 1, the closed-loop, engine fueling and spark control algorithm for cold-start, and the engine fueling and spark timing control algorithm provide an adaptively determined fuel injection signal 16 for controlling the operation of the fuel injector 18 and spark control signal 46 for controlling the operation of the spark plug 24. The timing and duration of fuel injection and, if applicable, spark ignition controls the operation of the engine, as indicated at Block 10, and accordingly the control of emissions discharged from the engine to the exhaust gas catalytic converter 34.

Variable valve actuation or cylinder deactivation is beneficial in attenuating the adverse effects of engine misfire. If either variable valve actuation (VVA) or cylinder deactivation is desired, as indicated at block 47 representing the WA/CYLINDER DEACTIVATION driver 47, the aforementioned control signals 45,49 are delivered to the engine 10 to respectively control operation of the intake and exhaust valves 36,42.

In accordance with the present invention, the effects of variations in the ion sensing characteristics of a spark plug, such as deposit buildup, different fuel properties, spark plug gap geometry, and other variations on the detected ion signal magnitude and pattern that would otherwise prohibit the use of a spark plug as an ion sensor are eliminated as a result of the on-line calibration provided by the oxygen sensor signal.

Thus, the apparatus and method embodying the present invention provide a simple, practical, and inexpensive control useful for decreasing hydrocarbon emissions from gasoline-powered vehicles during the initial operating period following a cold start. The present invention combines the fast detection provided by an ion sensor disposed in the combustion chamber with a heated $O_2$ sensor disposed in the exhaust system of a vehicle as an on-board calibration tool to calibrate the ion sensor for each specific sensor/engine combination.

In other embodiments, the in-cylinder ion sensor may be used to detect misfire and control engine operation to prevent damage to the catalytic converter. During misfire, unburned fuel is passed on to the catalytic converter, resulting in overheating of the catalyst and possible catastrophic damage to the aftertreatment device. In accordance with the present invention, the signal received from the ion sensor could be used to deactivate the exhaust valve in cylinders in which misfire is detected to trap in unburned charge in the cylinder on upcoming exhaust strokes and thereby protect the catalytic converter from damage due to overheating. This aspect of the present invention is equally applicable to diesel engines. Exhaust valve deactivation in diesel engines when a misfire condition is sensed will protect downstream aftertreatment devices from damage caused by unburned fuel being transmitted to the aftertreatment device.

Although the present invention is described in terms of preferred illustrative embodiments, those skilled in the art will recognize that the control signals described above are illustrative of a representative spark-ignition engine. The actual values of the described sensed and control signals are dependent upon the operating characteristics of a specific engine, fuel injector, spark-ignition device and oxygen sensor. Also, although not specifically described or shown, it should be realized that other engine control devices could be easily controlled using the adaptively calibrated ion sensor embodying the present invention. For example, the operation of intake and exhaust valves could be controlled if the engine is equipped with a variable valve actuation system, a cylinder deactivation system, as well as modulation of the intake air if the engine has a throttle disposed in the intake air system of the engine.

Other aspects, features, and advantages of the present invention may be obtained from a study of this disclosure and the drawings, along with the appended claims.

What is claimed is:

1. A method for controlling exhaust gas emissions during cold start of an internal combustion engine having an ion sensor disposed in intimate communication with at least one combustion chamber of the engine, said method comprising:

introducing a mixture of air and fuel into the combustion chamber of the engine;

combusting the mixture of air and fuel in the combustion chamber;

generating positively charged ions having a value representative of the oxygen content of the combusted mixture of air and fuel;

sensing the magnitude of ions existent in the combusted mixture of air and fuel and generating a first signal correlative of magnitude of ions existent in the combusted mixture of air and fuel;

comparing the value of the first signal correlative of the magnitude of ions existent in the combusted air and fuel mixture with a value representative of a desired magnitude of ions in an idealized combusted air and fuel mixture for the mitigation of undesirable products of combustion in exhaust gases discharged from said engine;

determining a difference between the first signal and the desired value of the first signal;

generating a second signal correlative of the difference between the first signal and the desired value of the first signal; and adjusting the air to fuel ratio of the mixture introduced into said combustion chamber in accordance with the value of said second signal.

2. The method, as set forth in claim 1, wherein said engine includes a spark ignition device disposed within the combustion chamber of the engine, and said sensing the magnitude of ions existent in the combusted mixture of air and fuel includes employing the spark ignition device to generate said first signal correlative of the magnitude of ions existent in the combusted mixture of air and fuel.

3. The method, as set forth in claim 1, wherein said engine includes an ion sensor disposed in an exhaust manifold of the engine in close proximity with an exhaust valve through which exhaust gases are discharged from the combustion chamber, and said sensing the magnitude of ions existent in the combusted mixture of air and fuel includes employing the ion sensor disposed in close proximity to the exhaust valve to sense the magnitude of ions existent in the combusted air and fuel mixture.

4. The method, as set forth in claim 1, wherein said engine includes an oxygen sensor disposed in an exhaust system of the engine, and said method includes:

heating the oxygen sensor to a predetermined functional operating temperature and generating a third signal representative of the oxygen content of exhaust gases discharged from the combustion chamber;

receiving the third signal;

comparing the received third signal with said first signal correlative of the magnitude of ions existent in the combusted mixture of air and fuel;

determining any difference between value of the first and third signals; and calibrating the first signal having a value correlative of the magnitude of ions existent in said combusted air and fuel mixture to bring the value of the first signal into congruence with the third signal generated by the oxygen sensor.

5. The method, as set forth in claim 4, wherein comparing the value of the first signal correlative of the magnitude of ions existent in the combusted air and fuel mixture with a value representative of a desired magnitude of ions in an idealized combusted air and fuel mixture for the mitigation of undesirable products of combustion in exhaust gases discharged from said engine includes comparing the value of the calibrated first signal with the value representative of a desired magnitude of ions.

6. The method, as set forth in claim 1, wherein said engine includes a spark ignition device disposed within said chamber and said method includes controlling the timing of electrical discharges from said spark ignition device in conformity with the generated second signal correlative of the difference between the first signal and the desired value of the first signal.

7. The method, as set forth in claim 1, wherein said engine has a variable valve actuation system, and said method includes comparing the value of the first signal correlative of the magnitude of ions existent in the combusted air and fuel mixture with a value representative of cylinder misfire, and providing a signal to the variable valve actuation system for deactivating at least one of an intake valve and an exhaust valve of a cylinder in which misfire is sensed.

8. The method, as set forth in claim 1, wherein said engine has a cylinder deactivation system, and said method includes comparing the value of the first signal correlative of the magnitude of ions existent in the combusted air and fuel mixture with a value representative of cylinder misfire, and providing a signal to the cylinder deactivation system for deactivating at least one of an intake valve and an exhaust valve of a cylinder in which misfire is sensed.

9. An apparatus for controlling exhaust gas emissions during cold start of an internal combustion engine having at least one combustion chamber, said apparatus comprising:

an ion sensor disposed in intimate fluid communication with the combustion chamber;

an engine control unit adapted to receive a signal from said ion sensor representative of the magnitude of ions existent in a mixture of air and fuel combusted within said combustion chamber, compare the value of the signal received from the ion sensor with a desirable value of ions in a combusted air and fuel mixture for mitigation of undesirable products of combustion in exhaust gases discharged from said engine, and generate control signals representative of the difference between the sensed value of the signal received from the oxygen sensor and the desired value of ions in the combusted mixture; and a fuel injector disposed in fluid communication with the combustion chamber adapted to receive one of the control signals generated by the engine control unit and inject fuel into said engine in accordance with said control signal.

10. The apparatus, as set forth in claim 9, wherein said ion sensor comprises a spark plug having a tip portion disposed within said combustion chamber and adapted to receive another one of the control signals generated by the engine control unit and produce an electrical discharge within the combustion chamber in accordance with said control signal.

11. The apparatus, as set forth in claim 9, wherein said engine has an exhaust system in fluid communication with said combustion chamber and said ion sensor is disposed in said exhaust system at a position adjacent to an exhaust valve controlling the discharge of combusted gases from said combustion chamber into the exhaust system.

12. The apparatus, as set forth in claim 9, wherein said engine has an exhaust system in fluid communication with said combustion chamber and said apparatus includes an oxygen sensor disposed in said exhaust system and adapted to generate a signal correlative of the amount of oxygen present in exhaust gas discharged from the combustion chamber of the engine, and said engine control unit is adapted to receive the signal generated by the oxygen sensor and calibrate the signal generated by the ion sensor representative of the magnitude of ions existent in a mixture of air and fuel combusted within said combustion chamber.

* * * * *